US006145257A

United States Patent [19]

Cappuccio

[11] Patent Number: 6,145,257

[45] Date of Patent: Nov. 14, 2000

[54] METHOD AND SYSTEM FOR FORMING WALLS

[76] Inventor: Anthony Cappuccio, 96 W. Grand St., Elizabeth, N.J. 07202

[21] Appl. No.: 09/099,960

[22] Filed: Jun. 19, 1998

Related U.S. Application Data

[60] Provisional application No. 60/050,377, Jun. 20, 1997.

[51] Int. Cl.[7] ..... E04C 2/52

[52] U.S. Cl. ..... 52/220.2; 52/781.8; 52/781.9; 52/733.2; 52/733.3; 52/721; 52/726; 52/739; 52/383; 52/309.11; 52/562; 52/281; 52/601; 52/612; 52/742.13; 52/742.14; 52/745.1; 52/745.19

[58] Field of Search ..... 52/220.1, 220.2, 52/731.1, 731.7, 731.8, 731.9, 733.2, 733.3, 421, 383, 309.11, 309.12, 439, 580, 742.13, 742.14, 745.1, 745.19, 426, 562, 481.1, 281, 601, 612

[56] References Cited

U.S. PATENT DOCUMENTS

| | | | |
|---|---|---|---|
| 1,265,447 | 5/1918 | Havens | 52/281 |
| 2,086,571 | 7/1937 | Novambere | 52/410 |
| 3,344,572 | 10/1967 | Sell | 52/426 |
| 3,481,093 | 12/1969 | Davidson | 52/426 X |
| 3,940,899 | 3/1976 | Balinski | 52/733.3 X |
| 4,263,765 | 4/1981 | Maloney | 52/562 |
| 4,314,430 | 2/1982 | Farrington | 52/309.12 X |
| 4,866,899 | 9/1989 | Houser | 52/733.3 X |
| 5,117,600 | 6/1992 | Yerushalmi | 52/426 X |
| 5,566,525 | 10/1996 | Schwarz | 52/220.2 X |
| 5,709,061 | 1/1998 | Dietrich | 52/426 |
| 5,735,090 | 4/1998 | Papke | 52/220.2 |
| 5,740,648 | 4/1998 | Piccone | 52/426 |

FOREIGN PATENT DOCUMENTS

| | | | |
|---|---|---|---|
| 2558868 | 8/1985 | France | 52/426 |
| 2646231 | 6/1977 | Germany | 52/281 |
| 131394 | 6/1978 | Germany | 52/481.1 |
| 1589113 | 5/1981 | United Kingdom | 52/481.1 |

*Primary Examiner*—Laura A. Callo

*Attorney, Agent, or Firm*—Mathews, Collins, Shepherd & Gould, P.A.

[57] ABSTRACT

A method and system for forming walls includes a dual-wall cavity. A stud is formed of an outer flange, middle flange and inner flange arranged in an "E" shape configuration. An outer panel attaches to the outer flange, a middle panel attaches to the middle flange and an inner panel attaches to the inner flange. An outer cavity is formed between the outer panel and the middle panel. The outer cavity can be filled with a filler material for providing structural and insulation features. Thereafter, an inner panel attaches to the inner flange for providing an inner cavity. The inner cavity can be used to house utility materials such as plumbing, air ducts, heating and electrical.

22 Claims, 5 Drawing Sheets

METHOD AND SYSTEM FOR FORMING WALLS

This application claims the priority of U.S. Provisional application No. 60/050,377 entitled Method and System Forming Walls filed on Jun. 20, 1997 hereby incorporated by reference into this application.

BACKGROUND OF THE INVENTION

1. Field of the Invention

The present invention relates to a method and system for framing walls having a dual-wall cavity in which a outer cavity houses insulation material and an inner cavity houses utility services.

2. Description of Related Art

Conventional methods for constructing housing structures and buildings include framing the walls with wooden studs, such as 2 inch×4 inch and 2 inch×6 inch boards and/or metal studs. Corners between walls are also formed with the studs. Sheets of plywood or particle board are attached to the outside surface of the studs to form an outer wall. Insulation may be placed on the inside surface of the outer wall for providing insulation to the housing structure. Electrical wiring, plumbing and air ducts can be installed within the studs, displacing the insulation. An inner wall is attached to the inner surface of the studs. For example, the inner wall can be formed of sheet rock. It is desirable to form walls having improved thermal and sound insulation, improved structural strength which can be easily erected.

SUMMARY OF THE INVENTION

Briefly described, the present invention relates to a method and system for forming walls having a dual-wall cavity. The method and system include framing the wall with a stud having flange members. Panels are attached to the flange members to form an outer cavity and an inner cavity. The outer cavity can be filled with a filler material for providing structural and insulation features. For example, the filler material can be a lightweight concrete. The inner cavity can be used to house utility materials such as plumbing, air ducts, heating and electrical. The thickness of each of the wall cavities can be varied according to the application for the constructed wall. The invention will be more fully described by reference to the following drawings.

DETAILED DESCRIPTION

During the course of this description, like numbers will be used to identify like elements according to the different figures which illustrate the invention.

Figure 1:
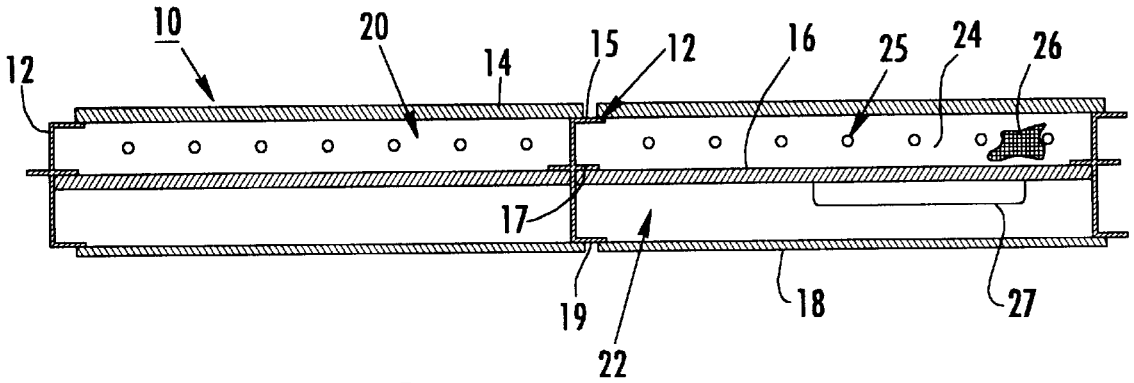
FIG. 1 is a horizontal cross sectional view of a method and system for forming a dual-wall cavity.

FIG. 1 illustrates a horizontal cross-sectional view of the method and system for forming a dual-wall cavity system 10 in accordance with the teachings of the present invention. A plurality of studs 12 are used to form dual-wall cavity system 10. Each of studs 12 can be attached to a bottom and top frame (not shown). For example, studs 12 can be formed of metal and can be attached with screws to the bottom and top frame. Outer panel 14 can be attached to outer portion 15 of stud 12. Middle panel 16 can be attached to middle portion 17 of stud 12. Inner panel 18 can be attached to inner portion 19 of stud 12. Outer cavity 20 is formed between outer panel 14 and middle panel 16 and inner cavity 22 is formed between middle panel 16 and inner panel 18. A plurality of outer panels 14, middle panels 16 and inner panels 18 can be attached to the plurality of studs 12. Outer cavity 20 can be filled with a filler material 24. Filler material 24 can provide structural and insulation valves to dual-wall cavity system 10.

The density of filler material 24 can be selected for a predetermined application. For example, a density of 20% of the filler material includes 80% air which provides improved insulation features. Alternatively, a density of 80% of the filler material includes 20% air and provides improved structural features. For example, filler material 24 can be selected as having a density in the range of 10 lbs/ft$^3$ to 145 lbs/ft$^3$. Preferably, filler material 24 is a liquid formed of a lightweight concrete. For example, lightweight concrete as manufactured by several manufacturers can be used in accordance with the teachings of the present invention. Alternatively, filler material 24 can be formed of a foam insulation. Reinforcement rods 25 and mesh 26 can be inserted into filler material 24. Preferably, reinforcement rods 25 and mesh 26 are formed of steel. Inner housing 27 can be attached to studs 12 to house utility services such as plumbing, heating, air ducts, electrical conduits, electrical wiring and computer wiring.

Outer panel 14, middle panel 16 and inner panel 18 can be formed of polyisocyanate, wood sheeting, particle chip board, flake board, gypsum board, cement board, plywood, foam attached to board, foam with a cover, and foam. Preferably, outer panel 14 and middle panel 16 are formed of an insulating foam material, such as polyisocyanate. It will be appreciated that outer panel 14, middle panel 16 and inner panel 18 can be formed of other known materials depending on the desired application.

Preferably, dual-wall cavity system 10 can be formed by the steps of installing studs 12 into frame tracks for framing stud 12, attaching outer panel 14 and middle panel 16 to stud 12 and inserting filler material 24 through outer wall flow ports 40 of stud 12 into outer cavity 20. Preferably, filler material 24 is a liquid insulating light weight concrete. Reinforcement rods 25 and mesh 26 can be inserted through outer wall ports 40 into filler material 24. Thereafter, the utility services installation can be performed in inner cavity 22. After installation of utility services in inner cavity 22, inner panel 18 can be attached to studs 12.

Alternatively, a panelized dual wall cavity system 10 can be formed by the steps of attaching outer panel 14 and middle panel to stud 12 to form a panel. The panelized dual wall cavity system 10 comprises a plurality of panels. The panelized dual-wall cavity system 10 can be off site fabricated and can be transported to the building site. Thereafter, the panels of the panelized dual-wall cavity system can be inserted into the frame tracks. Filler material 24 is inserted into outer cavity 20 and utility services are installed in inner cavity 22, with the steps described above. After installation of utility services in inner cavity 22, inner panel can be attached to studs 12.

Figure 2A:
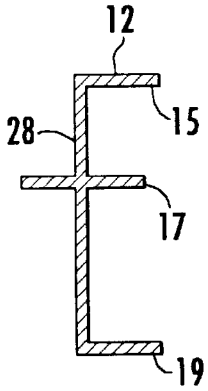
FIG. 2A is a horizontal cross section of a stud used in the system for forming a dual-wall cavity shown in FIG. 1.
Figure 2B:
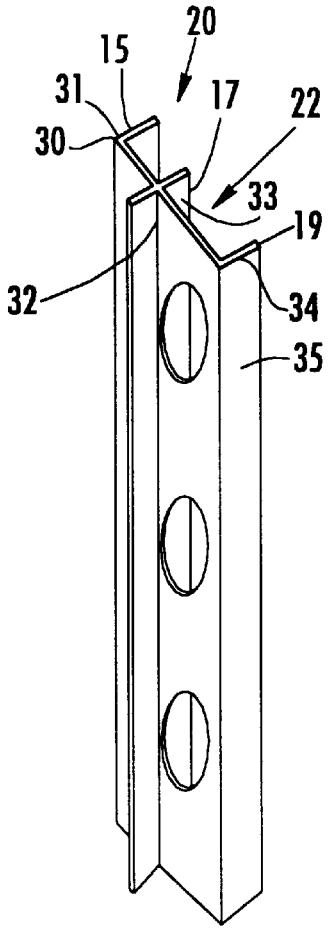
FIG. 2B is a perspective view of the stud.
Figure 2C:
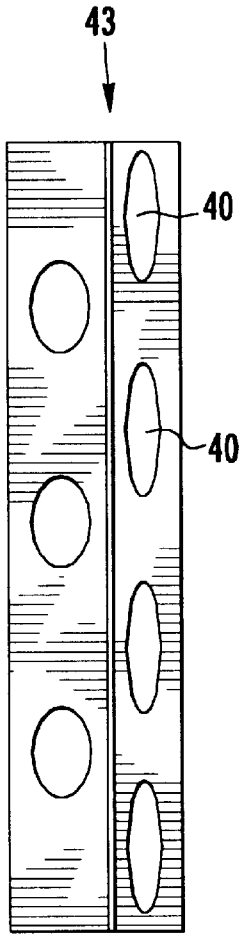
FIG. 2C is a right side view of FIG. 2B.
Figure 2D:
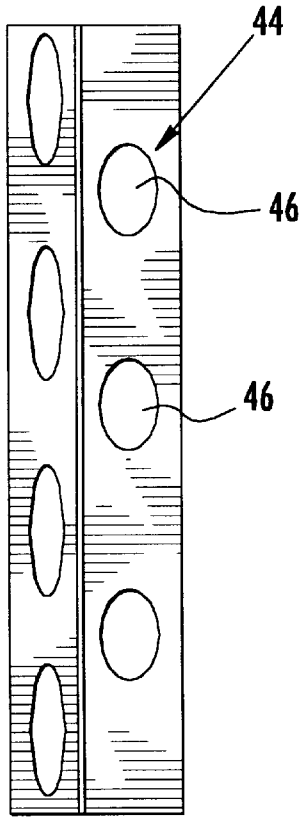
FIG. 2D is a left side view of FIG. 2B.

FIGS. 2A through 2D are detailed views of an embodiment of stud 12. FIG. 2A is a horizontal cross-section of stud 12 illustrating an "E" shaped configuration of outer portion 15, middle portion 17 and inner portion 19. Outer portion 15, middle portion 17 and inner portion 19 extend from elongated member 28. Outer flange 30 can form outer portion 15, middle flange 32 can form middle portion 17 and inner flange 34 can form inner portion 19. Outer panel 14 attaches to outer surface 31 of outer flange 30. Middle panel 16 attaches to inner surface 33 of middle flange 32 and inner panel 18 attaches to outer surface 35 of inner flange 34. Middle flange 32 can include second middle flange 39 for attaching to an adjacent middle panel 16. Second middle flange 39 extends to a direction opposite of middle flange 32, outer flange 30 and inner flange 34. Outer wall 43 of stud 12 can include outer wall flow ports 40 for receiving filler material 24. Inner wall 44 of stud 12 can include at least one utility port 46 for receiving the utility services.

Stud 12 can have a cross section in the range of 4 inches to 20 inches. Preferably, stud 12 has a cross section of 6 inches, 8 inches, 10 inches or 12 inches which are typical sizes of a conventional stud.

Figure 3:
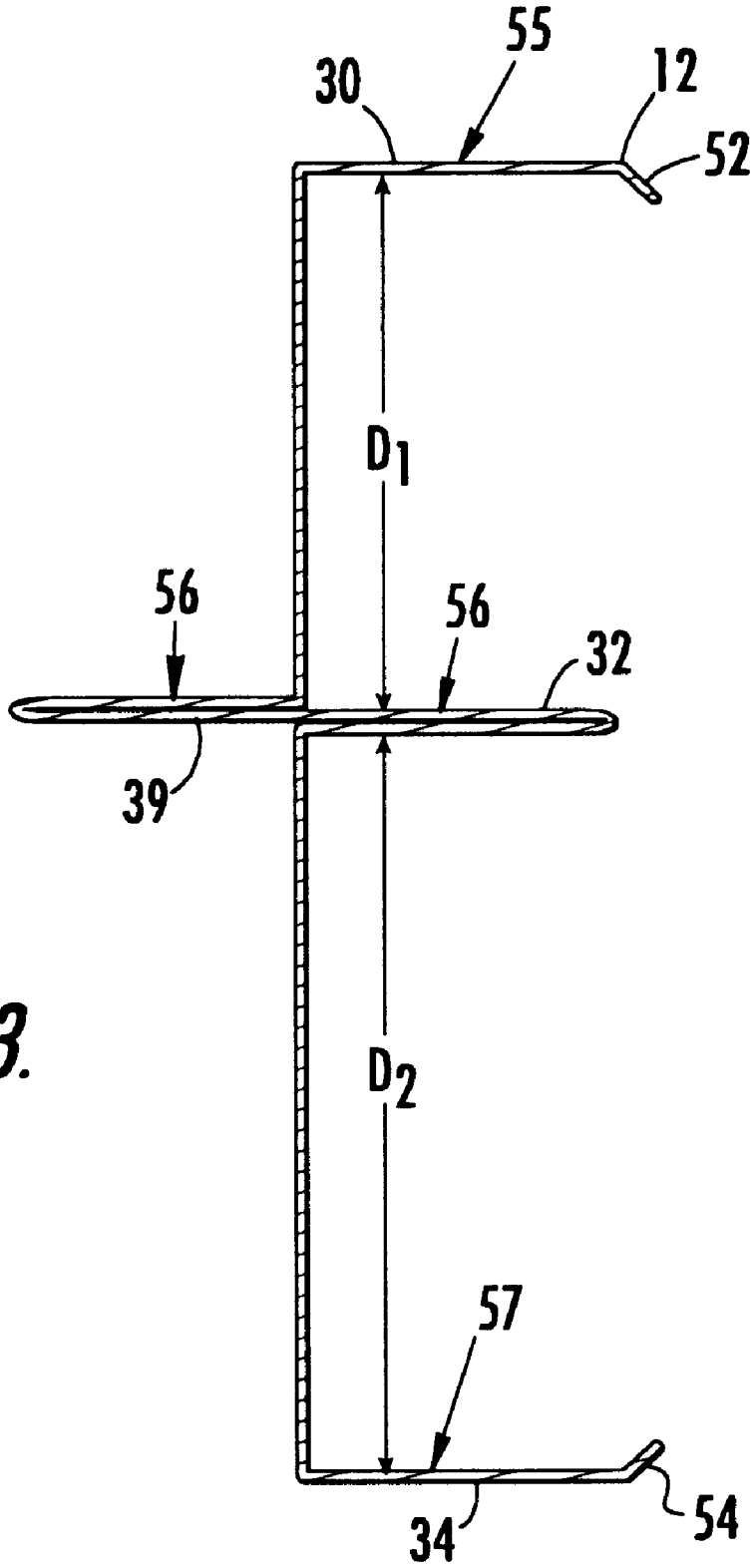
FIG. 3 is an alternate embodiment of the stud.

FIG. 3 illustrates an alternate embodiment of stud 12. End protrusion 52 extends from outer flange 30 and is angled towards middle flange 32. End protrusion 54 extends from inner flange 34 and is angled towards middle flange 32. End protrusions 52 and 54 provide improved structure of stud 12. Surface 55 of outer flange 30, surface 56 of middle flange 32 and surface 57 of inner flange 34 can have a textured or dimpled surface for providing an improved surface of attachment of respective outer panel 14, middle panel 16 and inner panel 18.

$D_1$ is the distance from middle flange 32 to outer flange 30 and $D_2$ is the distance from middle flange 32 to inner flange 34. In this embodiment, $D_2$ is greater than $D_1$ for providing a larger inner cavity 22. For example, for a stud 12 having a cross section of six inches, $D_1$ can be 2 and a half inches and $D_2$ can be 3 and a half inches. In alternate embodiments $D_1$ can be greater than $D_2$ for providing a larger outer cavity 20.

Figure 4A:
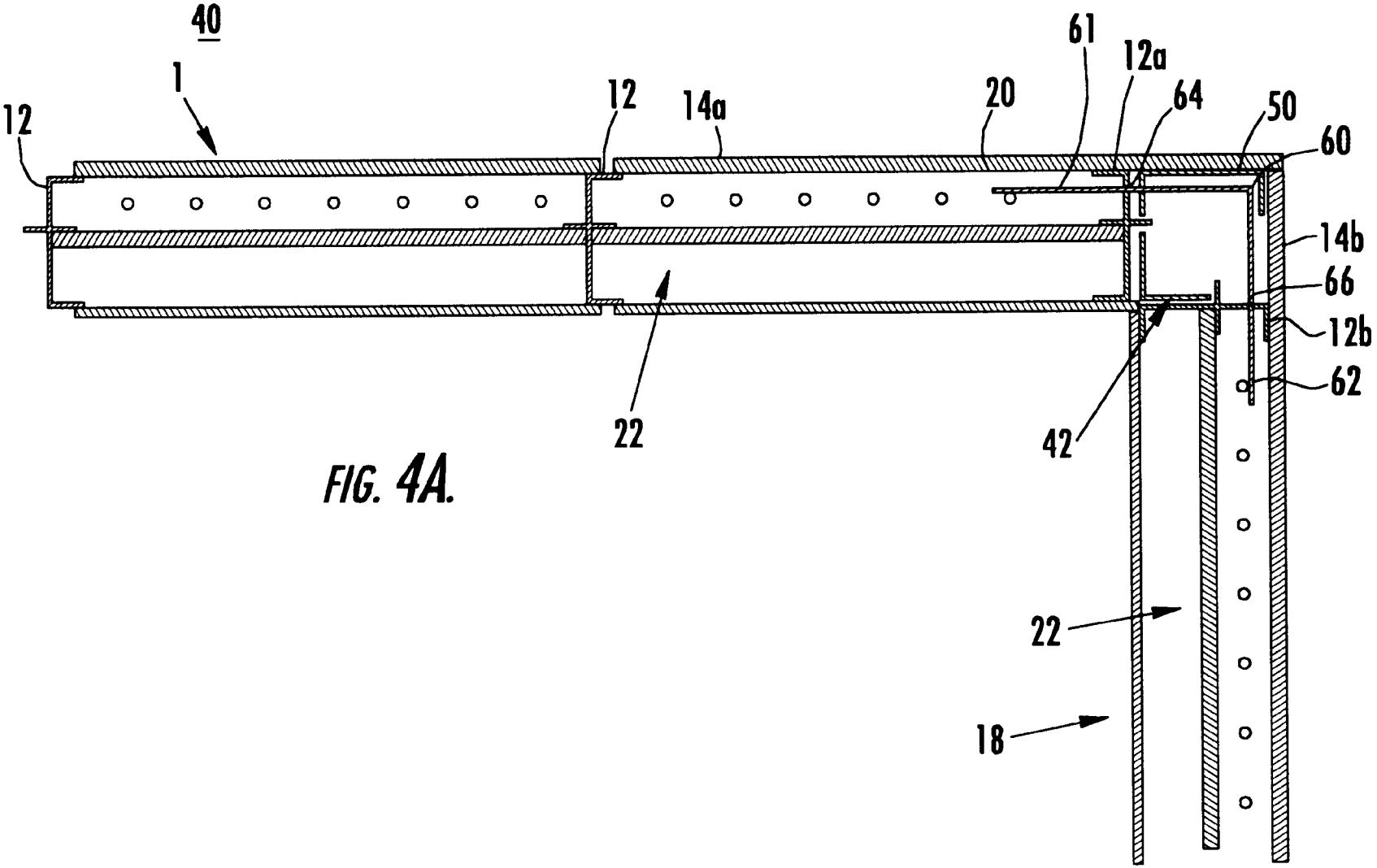
FIG. 4A is a horizontal cross sectional view of the dual-wall cavity system including a corner assembly.
Figure 4B:
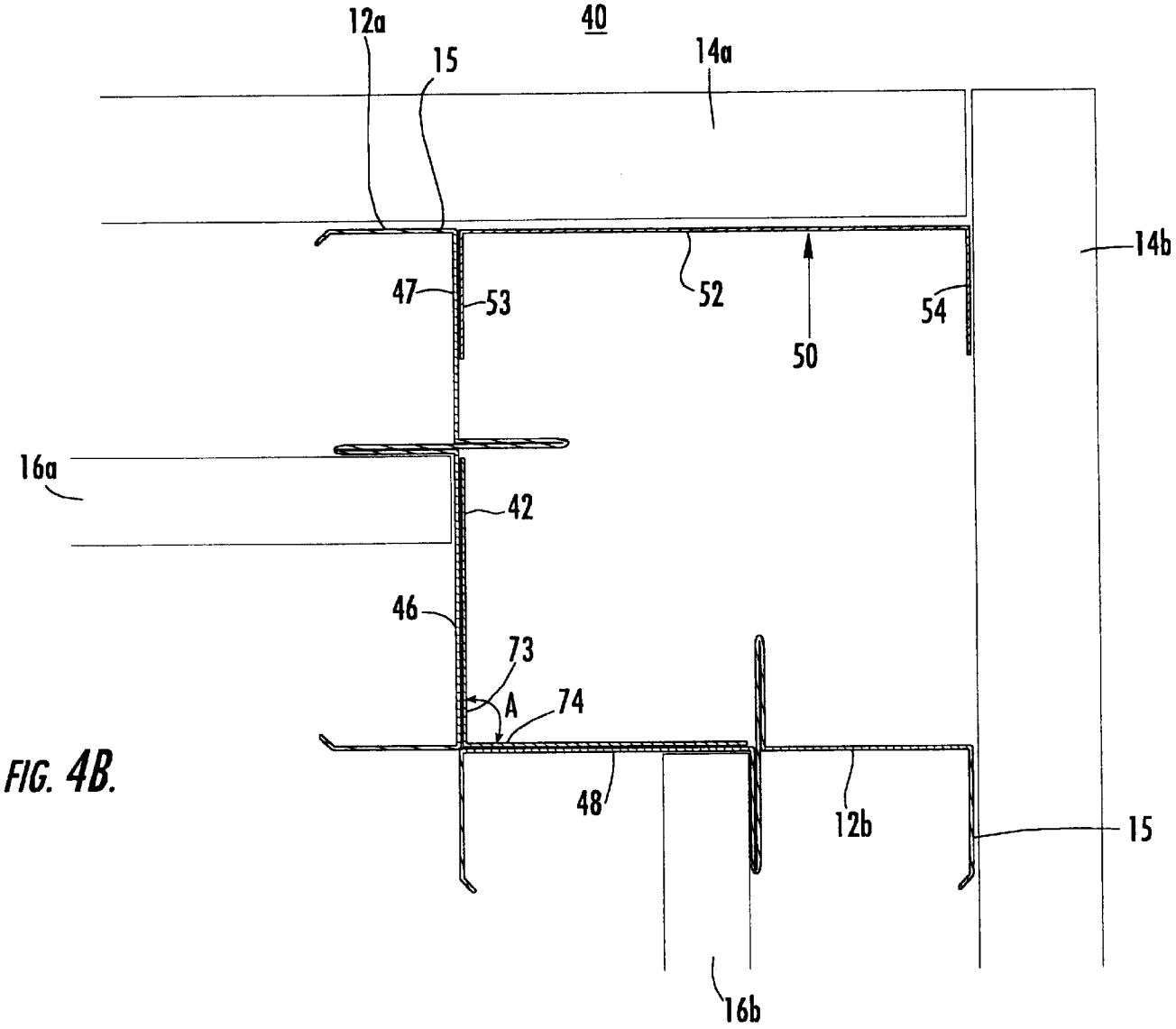
FIG. 4B is an enlarged cross sectional view of the corner assembly.

FIGS. 4A and 4B illustrate an embodiment of a corner assembly 40 of dual-wall cavity system 10 for connecting studs 12*a* and stud 12*b*. Corner angle 42 attaches stud 12*a* to stud 12*b*. Corner angle 42 is formed of end 73 and end 74. Angle A between end 74 and end 73 is in the range of about 45° to about 135°. Preferably, angle A is 90°. End 73 is coupled to side portion 46 of stud 12*a*. End 74 is coupled to side portion 48 of stud 12*b*.

Corner channel 50 is attached to stud 12*a*. Corner channel 50 is formed of body portion 52, and end portion 53 and end portion 54 for forming a "C" shape. Side portion 47 of stud 12*a* is coupled to end portion 53 of corner channel 50. Outer panel 14*a* is attached to outer portion 15 of stud 12*a* and body portion 52 of corner channel 50. Outer panel 14*b* is attached to outer portion 15 of stud 12*b* and end portion 54 of corner channel 50.

Corner dowel 60 can be inserted through stud 12*a* and stud 12*b* to provide additional structural support for corner assembly 40. Corner dowel 60 is formed of end 61 and end 62. End 61 is inserted through aperture 64 in stud 12*a* and end 62 is inserted through aperture 66 of stud 12*b*. Alternatively, corner dowel 60 can be inserted in outer wall flow port 40. A plurality of corner dowels 60 can be used to improve the load which dual-wall cavity system 10 can bear. For example, a dual-wall cavity system 10 can withstand hurricane force winds.

In general, the present invention has the advantage of providing improved thermal insulation and sound attenuation features, superior strength and ease of erection, and installation for many types of buildings, houses and commercial/industrial structure.

While the invention has been described with reference to the preferred embodiment, this description is not intended to be limiting. It will be appreciated by those of ordinary skill in the art that modifications may be made without departing from the spirit and scope of the invention.

I claim:

1. A method for forming a dual-wall cavity system comprising the steps of:

framing a plurality of elongated studs extending vertically, said studs having at least one outer flow port;

attaching an outer panel to an outer flange of said stud;

attaching a middle panel to a middle flange of said stud to form a first cavity between said outer panel and said middle panel;

inserting a filler material into said first cavity through said at least one outer flow port, said filler material is selected from the group consisting of concrete, light weight concrete, mortar and insulated concrete; and attaching an inner panel to an inner flange of said stud to form a second cavity between said middle panel and said inner panel, said outer flange, said middle flange, said inner flange and said stud integrally having an "E" shaped configuration with each said flange extending along a vertical length of said stud.

2. The method of claim 1 further comprising the step of inserting reinforcement rods through said at least one outer flow port into said filler material.

3. The method of claim 1 further comprising the steps of:

inserting at least one utility material into said second cavity.

4. The method of claim 1 wherein said stud further comprises:

at least one utility port and at least one utility material is inserted through said at least one utility port.

5. The method of claim 4 wherein said utility material is selected from the group consisting of plumbing material, heating material, air duct, electrical conduit and wiring.

6. The method of claim 1 wherein said outer panel, said middle panel and said inner panel are formed of a material selected from the group consisting of polyisocyanate, wood sheeting, particle chip board, particle board, flake board, gypsum board, cement board, plywood, foam attached to board, foam with a cover and foam board.

7. A method for forming a dual-wall cavity system comprising the steps of:

framing a plurality of studs, said studs having at least one outer port;

attaching an outer panel to an outer portion of said stud;

attaching a middle panel to a middle portion of said stud to form a first cavity between said outer panel and said middle panel;

inserting a filler material into said first cavity;

attaching an inner panel to an inner portion of said stud to form a second cavity between said middle panel and said inner panel;

attaching a corner angle to a first of said studs and a second of said studs, said corner angle being attached to a respective first side surface between said middle portion and said inner portion of said first of said studs and said second of said studs;

attaching a corner channel to said first of said studs, said corner channel having a body portion between a first end portion and a second end portion;

attaching said first end portion of said corner channel to said first stud, said corner channel being attached to a second side surface of said first stud between said middle portion and said outer portion;

attaching a first said outer panel to said first end portion of said corner channel; and attaching a second said outer panel to said second end of said corner channel.

8. The method of claim 7 further comprising the step of inserting at least one corner dowel into an aperture of said first of said studs and an aperture of said second of said studs.

9. A dual-wall cavity system comprising:

a plurality of elongated studs, adapted for extending vertically from a frame, each of said studs comprising an outer flange, a middle flange and an inner flange said middle flange being between said outer flange and said inner flange;

an outer panel, said outer panel capable of being attached to said outer flange;

a middle panel, said middle panel capable of being attached to said middle flange to form a first cavity between said outer panel and said middle panel; and an inner panel, said inner panel capable of being attached to said inner flange to form a second cavity between said middle panel and said inner panel, said outer flange, said middle flange, said inner flange and said stud integrally having an "E" shaped configuration with each said flange extending along a vertical length of said stud.

10. The system of claim 9 wherein said middle flange comprises:

a first middle flange extending in the same direction as said outer flange and said inner flange; and a second middle flange extending in the opposite direction of said outer flange and said inner flange.

11. The system of claim 10 further comprising:

a filler material capable of being inserted in said first cavity.

12. The system of claim 11 wherein said stud further comprises an outer port for receiving said filler material.

13. The system of claim 12 wherein said filler material is selected from the group consisting of concrete, light weight concrete, mortar and insulated concrete.

14. The system of claim 9 wherein said stud further comprises a utility port capable of receiving a utility material.

15. The system of claim 9 wherein said outer panel and said middle panel are formed of an insulating foam material.

16. The system of claim 9 wherein said outer panel, said middle panel, and said inner panel are formed of a material selected from the group consisting of polyisocyanate, wood sheeting, particle chip board, flake board, gypsum board, cement board, plywood, foam attached board, foam with a cover and foam board.

17. A stud for a dual cavity wall system, said stud comprising:

an elongated member having a first and second side surface adapted for extending vertically from a frame;

an outer flange extending from said first side surface of said elongated member;

an inner flange extending from said second side surface of said elongated member; and a first middle flange extending from said elongated member between said first side surface and said second side surface in the same direction as said outer flange and said inner flange, said outer flange, said middle flange, said inner flange and said stud integrally having an "E" shaped configuration with each said flange extending along a vertical length of said stud.

18. The stud of claim 17 further comprising:

at least one outer flow port formed in said elongated member between said outer flange and said first middle flange.

19. The stud of claim 17 further comprising at least one inner port formed in said elongated member between said first middle flange and said inner flange.

20. The stud of claim 17 wherein said elongated member, said outer flange, said middle flange and said inner flange are integral and are formed of metal.

21. The stud of claim 17 further comprising a second middle flange extending from said elongated member between said first side surface and said second side surface in the opposite direction of said outer flange and said inner flange.

22. A panelized dual-wall cavity system comprising:

a plurality of elongated studs adapted for extending vertically from a frame, each of said studs comprising an outer flange, a middle flange and an inner flange, said middle flange being between said outer flange and said inner flange, said outer flange, said middle flange, said inner flange and said stud integrally having an "E" shaped configuration with each said flange extending along a vertical length of said stud;

an outer panel, said outer panel attached to said outer flange;

a middle panel, said middle panel attached to said middle flange to form a first cavity between said outer panel and said middle panel; and an inner panel, said inner panel capable of being attached to said inner flange to form a second cavity between said middle panel and said inner panel.

* * * * *